United States Patent [19]

McGinnis

[11] 4,204,675

[45] May 27, 1980

[54] AIR CHAMBER LEG EXERCISING DEVICE

[75] Inventor: Gerald E. McGinnis, Monroeville, Pa.

[73] Assignee: Monicor Corp., Monroeville, Pa.

[21] Appl. No.: 930,314

[22] Filed: Aug. 2, 1978

[51] Int. Cl.[2] ..... A63B 21/00

[52] U.S. Cl. ..... 272/130; 272/DIG.1

[58] Field of Search ..... 272/96, 76, 97, 78, 272/100, 136, 66, 138, 70, 141, 116, 120, 130, 134, 135, DIG. 1; 150/10; 222/407; 128/25 B, 50 R, DIG. 20, 66, 57 D

[56] References Cited

U.S. PATENT DOCUMENTS

| | | | |
|---|---|---|---|
| 750,593 | 1/1904 | Cady | 272/76 X |
| 2,714,011 | 7/1955 | Albee | 272/130 |
| 3,167,312 | 1/1965 | Blanchard | 272/141 |
| 3,734,496 | 5/1973 | Rubin | 272/65 |
| 3,821,951 | 7/1974 | Giles | 272/96 X |
| 4,065,124 | 12/1977 | Egan | 272/65 |
| 4,111,416 | 9/1978 | Jinotti | 272/96 |

FOREIGN PATENT DOCUMENTS

| | | | |
|---|---|---|---|
| 912602 | 10/1972 | Canada | 272/96 |
| 1020677 | 2/1966 | United Kingdom | 272/65 |

*Primary Examiner*—William R. Browne

*Attorney, Agent, or Firm*—Brown, Flick & Peckham

[57] ABSTRACT

A pair of laterally spaced foot treadles are hinged at their front ends to one end of a hollow base and normally are held in an inclined position by springs. Mounted between each treadle and the base is a normally inflated flexible air chamber that communicates with an air inlet and an air outlet in the base provided with check valves. The outlets of the outlet valves are connected by a conduit that is provided with an exhaust valve, the opening of which is resisted when either treadle is depressed, whereby it requires effort to expel air from the underlying chamber.

7 Claims, 6 Drawing Figures

AIR CHAMBER LEG EXERCISING DEVICE

In recent years the value of exercise has been shown to be very beneficial, particularly when the exercise is aerobic; that is to say, exercise that leads to elevated heart rate for extended periods of time. Many kinds of exercise apparatus have been developed, both for aerobic exercise and for muscular development type exercise. The present invention relates to an aerobic exerciser that is intended to provide most of the benefits of stair climbing, jogging or running, while at the same time providing the additional benefit of avoiding the shock to ankles, hips and knees, which is commonly experienced by joggers.

It also is among the objects of this invention to provide an exerciser which is of relatively simple and inexpensive construction, which does not require any liquid in its operation, and which is adjustable to require different degrees of effort in order to operate it.

The preferred embodiment of the invention is illustrated in the accompanying drawings, in which FIG. 1 is a plan view;

Figure 3:
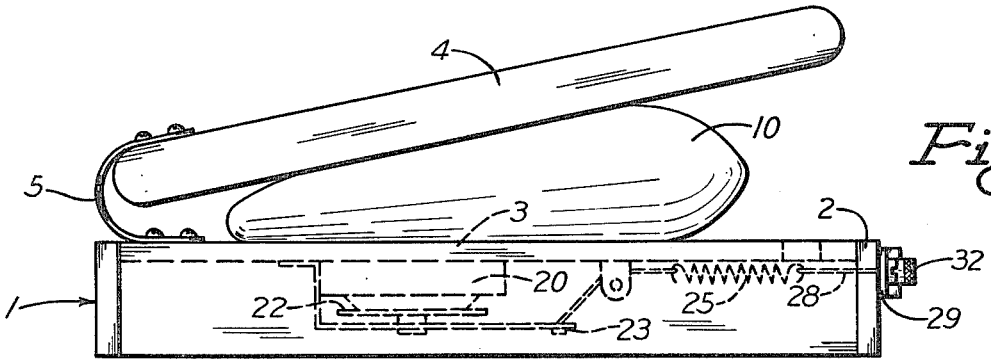
FIG. 3 is a side view.

Referring to the drawings, a hollow base 1 is shown, which is made from strips of wood fastened together to form a rectangular frame 2 provided with a flat top 3. If desired, the base could be made from a molded plastic. The bottom of the frame may be closed by a removable rectangular plate (not shown). Overlying base 1 is a pair of laterally spaced foot treadles 4, the rear ends of which are connected by spring strip hinges 5 to the underlying front end of top 3. When the treadles are not in their raised position they are substantially parallel to the top of the hollow base. Normally, however, the treadles are inclined upwardly from back to front as shown in FIG. 3. They are held in this position by the spring hinges when there is no weight on the treadles.

Figure 5:
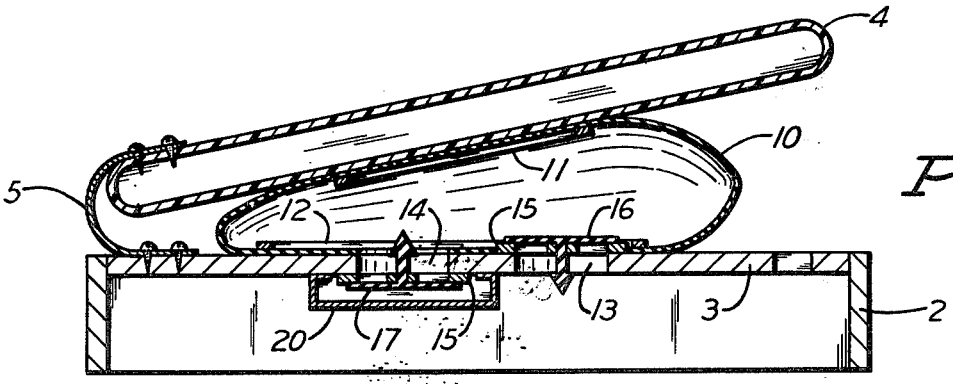
FIGS. 5 and 6 are vertical sections taken on the lines V—V and VI—VI, respectively, of FIG. 2.

Between each treadle and the hollow base there is a flexible air chamber, preferably a rubber or plastic bag 10. The bag can be connected to the bottom of the overlying treadle by rigid strips 11 (FIG. 5) inside the bag connected by screws to the treadle so that the top of the bag is clamped against it. In the same way rigid strips 12 clamp the bottom of the bag to the top of the base. The bag is provided with two openings. These are shown in the bottom of the bag, one in front of the other. These openings overlie a pair of openings 13 and 14 in the top 3 of the base, as shown in FIG. 5. A perforated member or grid 15 extends across each base opening. The rear grid is covered by an upwardly movable diaphragm 16 forming a check valve, so this opening 13 into the bag serves as an air inlet. A similar, but downwardly opening, check valve 17 is mounted below the other opening 14, which serves as an air outlet. Thus, when a treadle is depressed, it compresses the underlying bag and forces air out through its outlet opening. When the treadle is raised by its spring hinge, air is drawn into the bag through its inlet opening 13.

Figure 6:
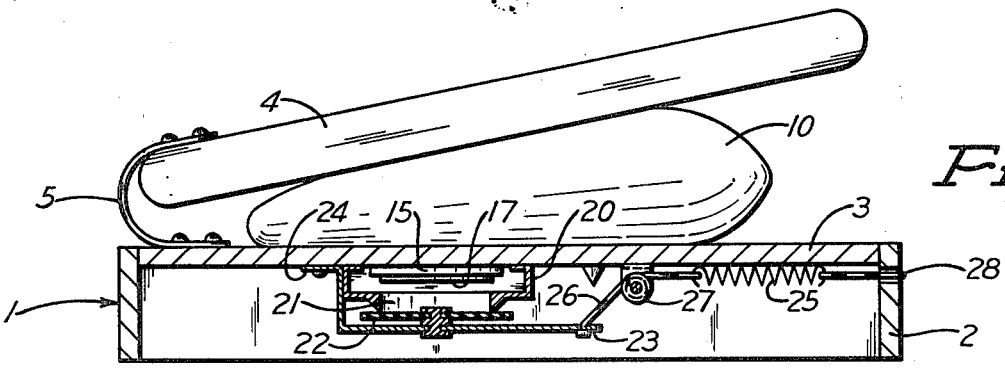

In order to control the ease or difficulty with which the bags are compressed, and therefore the energy that must be expended in doing so, the air outlets 14 are connected by a conduit 20 below them and this conduit is provided with an exhaust port 21 as shown in FIG. 6, preferably midway between the two valves. A valve for the exhaust port is formed from a closure disc 22 beneath the port and the disc normally is urged upwardly to closing position by means of a lever 23 that is flexibly connected at one end 24 to the top of the base so that the opposite end of the lever can move up and down. To hold the lever in its upper valve-closing position and to resist opening of the exhaust valve, a spring 25 is connected between the free end of the lever and base 1. If desired, a separate exhaust valve could be provided for each air outlet, but both should be adjustable in unison so that both bags will provide the same resistance to being compressed.

Figure 1:
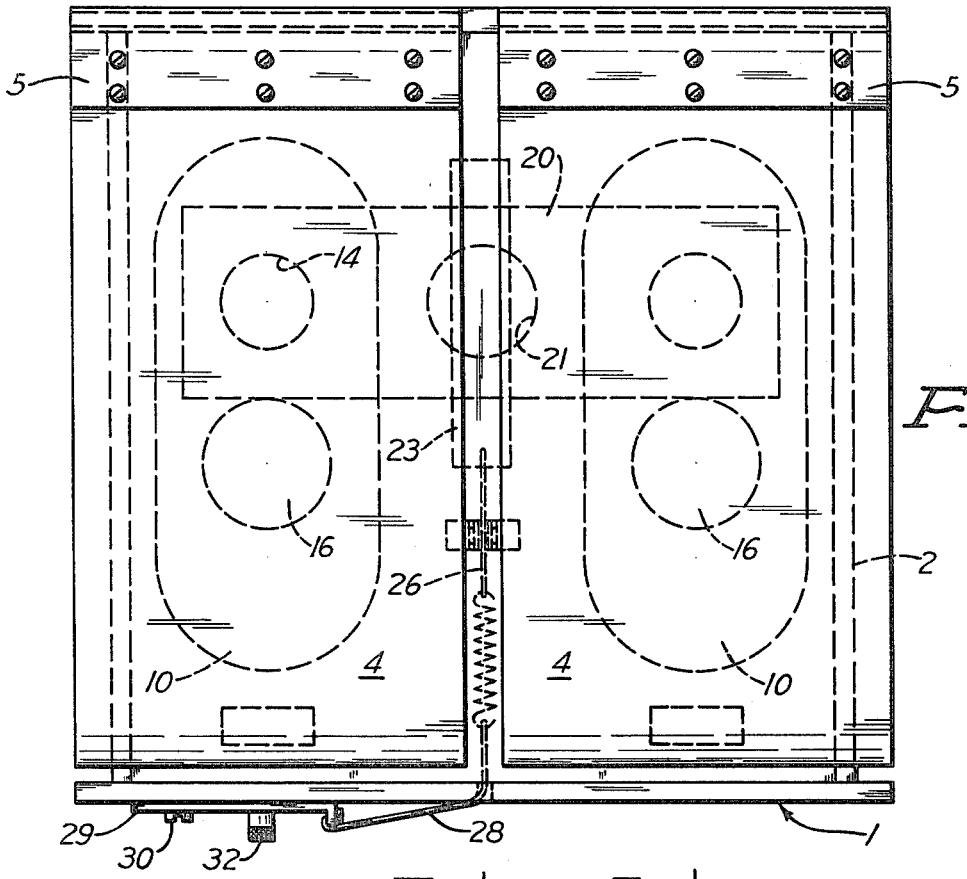
Figure 2:
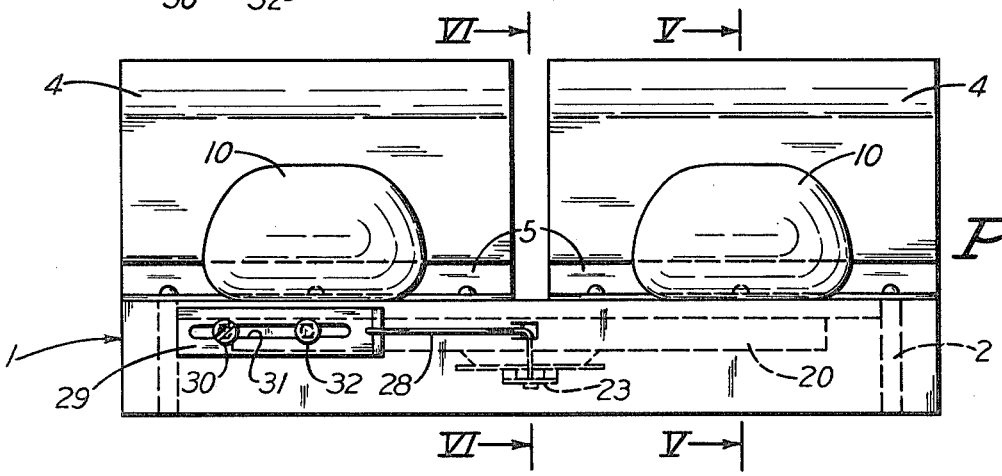
FIG. 2 is a rear view.
Figure 4:
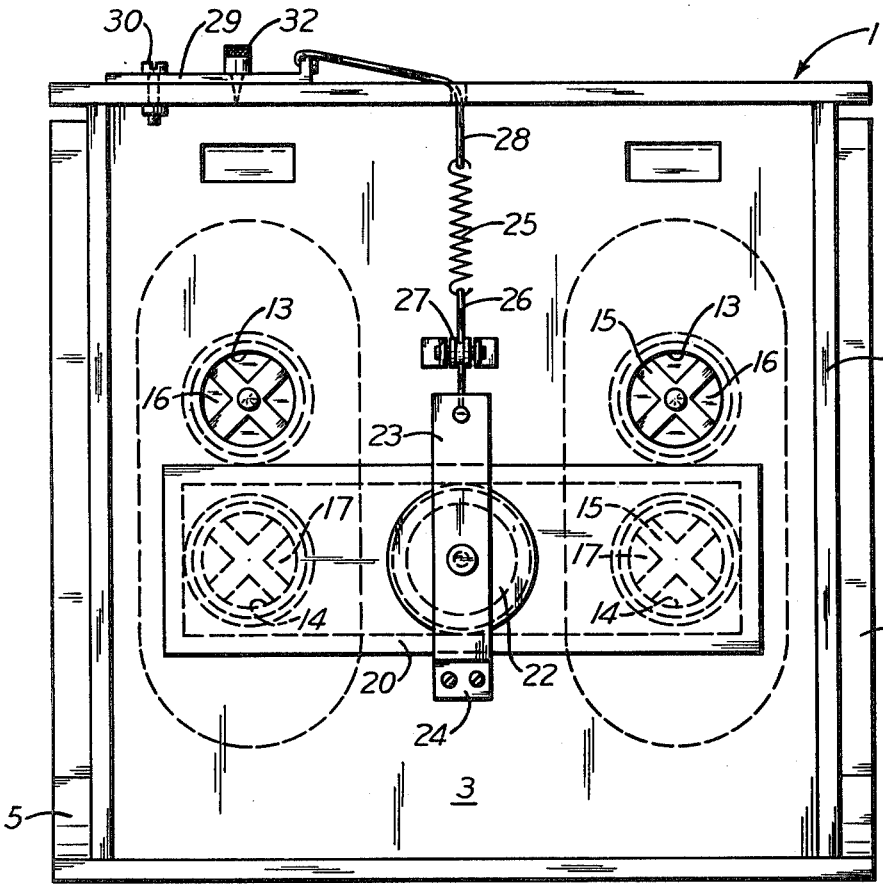
FIG. 4 is a bottom view.

The tension on spring 25 determines the amount of effort required to cause the air in the bags to force the exhaust valve 22 off its seat. Preferably, this tension is adjustable. Thus, a line 26 attached to the free end of the lever extends upwardly and over a support such as a small grooved roller 27 suspended from the top of the hollow base, and then rearwardly toward the back of the base. This line is connected to one end of coil spring 25, the opposite end of which is connected to a line 28 that extends out through a hole in the back of the base. Preferably, as shown in FIGS. 1, 2 and 4, the outer end of the line is attached to one end of a plate 29 held flat against the back of the base by the head of a bolt 30 that passes through a longitudinal slot 31 in the plate and through the back of the base. This plate can be moved lengthwise along the base to different positions and then clamped in place by means of a thumb screw 32 extending through the slot and into the base. The position of the plate along the base determines the tension on the spring and lever.

OPERATION

In operation, the user sets this exerciser on the floor and then stands with one foot on each treadle. By shifting his weight back and forth from one foot to the other as he lifts and lowers his feet, he causes a treadle to swing up as the other treadle is depressed, thereby compressing the air in the bag beneath the downwardly moving treadle. Due to the resistance of the exhaust valve 22 to expulsion of air from the bags, it requires effort to depress the treadles. The required effort is determined by the tension on spring 25 connected to the exhaust valve lever 23. The more effort that is required, the more muscular development in the legs and the greater overall exertion of the body, which increases the heart rate.

In shifting weight from one treadle to the other, the body must be lifted from the depressed treadle to the elevated treadle to provide sufficient weight to cause the exhaust valve to open, whereupon the elevated treadle will descend rapidly. While one treadle is descending, the other rises. The net result is an exercise work-out for all of the muscles used in climbing stairs, if the user goes slowly. If the user chooses to go rapidly, such as at a jogging or a running pace, additional muscles that are used in lifting the legs rapidly are loaded. The muscles loading is very similar to jogging or running up a slight grade. Consequently, when the spring is adjusted to provide sufficient loading, the user will find that all of the major muscles of the legs and upper body can be exercised. If one chooses to run rapidly on the device, he can decrease the load on the spring to obtain a balance between the pace which he chooses to run and the load, or grade, consistent with the capacity of his heart and lungs to provide aerobic balance.

The primary advantage of this device is that it allows aerobic exercise to be done on a small, light-weight, inexpensive device indoors without the problems due to weather, traffic, etc. A further beneficial advantage of the device is the cushioning provided for the joints of the user, the shock to which can be severe when actually running or jogging or even running in place. If desired, the treadles can be covered by soft or resilient pads.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. An exerciser comprising a base having front and rear ends, a pair of laterally spaced foot treadles overlying the base and hinged at their front ends to the front end of the base, the treadles normally being inclined with their rear ends raised above the base, a normally inflated flexible air chamber mounted between each said treadle and the base and attached thereto, the base having a pair of openings therein beneath each of said chambers, said chambers having inlet and outlet openings therein communicating with said base openings, one of the base openings for each chamber being an air inlet and the other base opening being an outlet, an inwardly opening check valve for each inlet, an outwardly opening check valve for each outlet, and means for resisting discharge of air from said chambers as said treadles are depressed alternately to expel air from the chambers.

2. An exerciser according to claim 1, including means for adjusting said discharge-resisting means, whereby to change the force required to depress said treadles.

3. An exerciser according to claim 1, in which each of said air chambers is a flexible bag.

4. An exerciser according to claim 1, including means for adjusting the force exerted by said spring against said lever.

5. An exerciser according to claim 1, in which said spring pressing the lever is a coil spring, including means connecting one end of the spring to the free end of the lever, a line connected to the opposite end of the spring, and means connecting said line to the base, said last-mentioned means being adjustable along the base to vary the tension in the spring.

6. An exerciser according to claim 5, including a support secured to said base adjacent the free end of said lever, and said connecting means is a line passing over said support to pull the lever toward said exhaust valve.

7. An exerciser according to claim 1, in which said air discharge-resisting means include a conduit connecting the outlets of said outlet check valves and provided with a single exhaust opening, an exhaust valve for said exhaust opening of the conduit, a lever engaging said exhaust valve and flexibly connected at one end to said base, and a spring pressing the lever against the exhaust valve to close it.

* * * * *